US005444942A

United States Patent [19]

Knudsen

[11] Patent Number: 5,444,942

[45] Date of Patent: Aug. 29, 1995

[54] WINDOW CONSTRUCTIONS

[75] Inventor: Rolf A. Knudsen, Vatne, Norway

[73] Assignee: A/S Spilka International Ltd., Alesund, Norway

[21] Appl. No.: 82,764

[22] Filed: Jun. 25, 1993

[30] Foreign Application Priority Data

Jun. 30, 1992 [NO] Norway ..... 922578

[51] Int. Cl.[6] ..... E05D 15/56

[52] U.S. Cl. ..... 49/261; 49/252

[58] Field of Search ..... 49/246, 248, 250, 252, 49/253, 260, 261, 249, 251, 257, 258; 403/131, 133, 122, 135

[56] References Cited

U.S. PATENT DOCUMENTS

| | | | |
|---|---|---|---|
| 1,590,545 | 6/1926 | Peterson | 49/252 |
| 1,760,994 | 6/1930 | Piotti | 49/252 |
| 2,718,675 | 9/1955 | Olsen | 49/252 |
| 4,986,028 | 1/1991 | Schneider et al. | 49/252 X |

FOREIGN PATENT DOCUMENTS

| | | |
|---|---|---|
| 057976 | 5/1937 | Norway . |
| 138221 | 11/1977 | Norway . |
| 338591 | 7/1959 | Switzerland . |

*Primary Examiner*—Jerry Redman
*Attorney, Agent, or Firm*—Mcaulay Fisher Nissen Goldberg & Kiel

[57] ABSTRACT

A side-hinged, 180 degrees rotatable window, having a window casement which is pivotably mounted about a first vertical axis and about a second vertical axis relative to a window frame. The window casement is supported hanging at its one upper corner via a head portion (27) on a pivot pin (26) in a carriage (25), which is displaceable in a horizontal guide (16) in the window frame. The window casement is pivotably mounted at its center axis at the one end of an upper and a lower support or pivot arm, the opposite end of which is pivotably mounted about a third vertical axis in the window frame. The carriage (25) is designed with a part-spherical seat (25') for an equivalent part spherical portion of the support head (27) of the first pivot pin.

11 Claims, 5 Drawing Sheets

FIG. 3
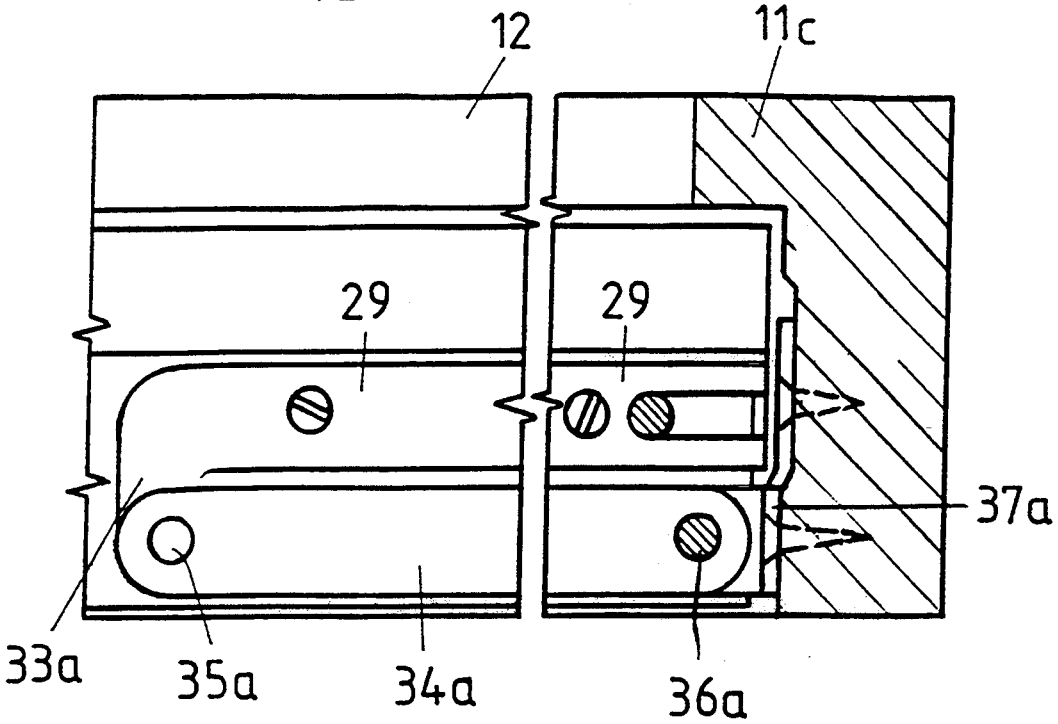
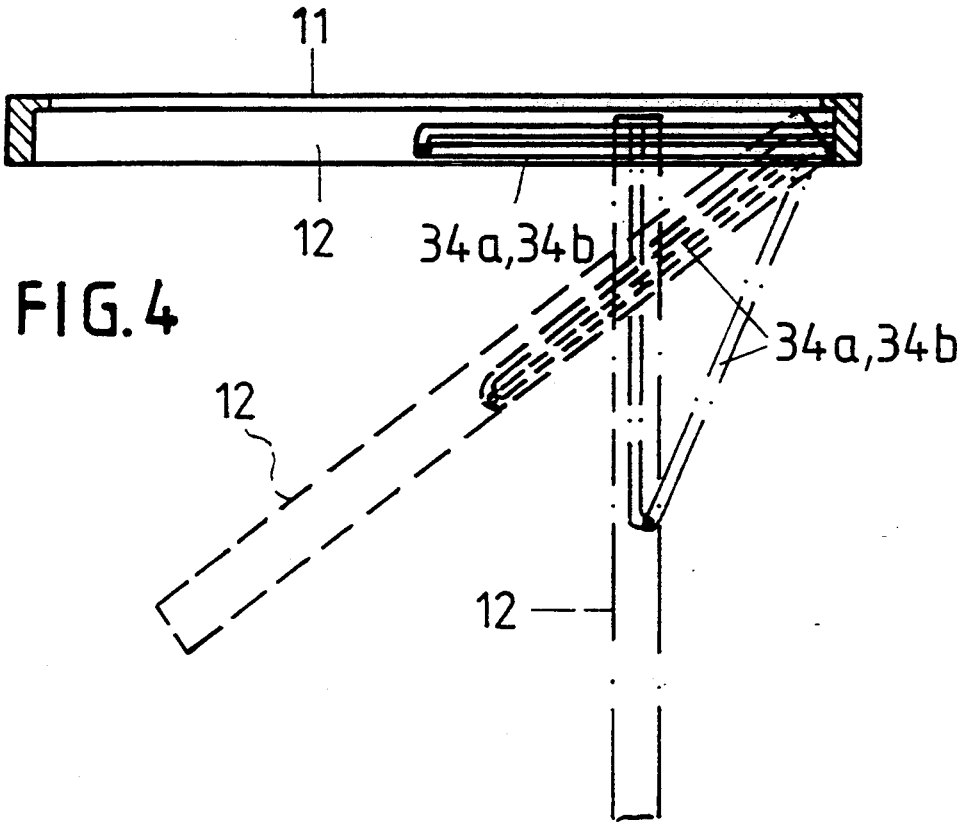
FIG. 4

WINDOW CONSTRUCTIONS

BACKGROUND OF THE INVENTION

This invention relates to window constructions.

Norwegian Patent 172,506 discloses a side-hinged, 180 degrees rotatable window, where a window casement is pivotably mounted about a first vertical axis at one upper corner of the window casement via a first pivot pin in an upper carriage-forming guide component, which is displaceable in a first horizontal guide in an associated window frame, and at one lower corner via a second pivot pin in a lower guide component, which is displaceable in a second horizontal, lower guide in the window frame. The window casement is also pivotably mounted approximately at its center axis about a second vertical axis, at one end of an upper and lower support or pivot arm, the opposite end of which is pivotably mounted about a third vertical axis at an associated corner of the window frame, where the carriage-forming guide component is adapted to support the window casement in a suspended condition via a support head at the upper end of a stem portion of the first pivot pin.

In a window of the afore-mentioned kind, the weight of the window casement will be transferred to a substantial degree along the first pivotal axis of the window casement via the upper window casement corner by means of the carriage-forming guide component in the window frame, while the window casement is held in place in an intended vertical position via the second pivotal axis by means of the upper and the lower pivot arm, which are both pivotably mounted at the one end at the vertical center axis of the window casement and at the other end at one vertical frame portion of the window casement. The other lower corner of the window casement at the first pivotal axis serves essentially to correct the position of the window casement, so that the window casement is held in place in a vertical position, without absorbing the weight loading and substantially with minimal supporting effect. It is an advantage that the lower guide component and the associated lower guide can be designed in a simple manner—without having to absorb any weight loading or any decisive controlling effect—so that, in practice the lower guide component does not play any significant role in the mode of operation of the window even if the lower guide should become choked with dust or other foreign bodies in the ventilation position or during use of the window.

By the very fact that the window casement is suspended with the weight loading from the window casement to the window frame at one upper corner of the window casement, it is of considerable importance that the carriage-forming guide component at one, upper corner of the window casement can be displaced relatively unhindered forwards and backwards along the horizontal guide. The support pin is preferably rigidly fastened to the casement, so that the support pin and associated support head will be moved correspondingly to the window casement. Even a relatively moderate outward pivoting angle for the first pivotal axis of the window casement—for example the cause of a certain free outward pivoting of the window casement at its lower corner at the first pivotal axis relative to the window frame—can result in an unsatisfactory rocking about of the carriage and a wedging of the carriage following from this in the associated horizontal guide in the window frame. Correspondingly, even a small constructional inaccuracy between the center line of the support pin and the center of the pivotal movement will produce a forced pivoting about of the carriage and wedging of the latter in the associated guide.

Accordingly, it is an object of the invention to avoid jamming of a pivotally mounted window casement during a pivoting movement in a window frame.

It is another object of the invention to permit an unhindered forward and backward movement of a guide carriage for a pivotally mounted window casement in a horizontally disposed guide of a window frame.

It is another object of the invention to compensate for small constructional inaccuracies between the centerline of a support pin on a window casement and a carriage receiving the pin in weight supporting manner during travel of the carriage along a guide in a window frame.

Briefly, the invention provides a window construction comprising a window frame, a window casement mounted in the frame and a pair of horizontally disposed support arms. Each of the support arms is pivotally secured at one end to the window frame on a first vertical axis and pivotally secured at an opposite end to the window casement on a second vertical axis disposed in a mid-area of the window casement. The arms are also disposed on opposite sides of the casement, that is, at the top and bottom of the casement, in order to permit pivoting of the casement about the second vertical axis, for example, through 180°.

In addition, the window frame has a horizontally disposed guide in an upper side thereof while a carriage disposed in the guide to move along the guide during pivoting of the casement about the second axis. This carriage includes a support member having a vertically disposed bore and a part-spherical seat concentric to the bore as well as plurality of wheels supporting the support member for movement along the guide in the window frame. A pivot pin is secured to the casement and passes through the bore of the support member of the carriage. This pin also has a part spherically shaped head pivotally mounted on the seat of a support member for supporting the casement from the carriage and, thus, the guide of the window frame during movement of the carriage along the guide.

The window frame also has a horizontally disposed rail on a lower side, that is, the bottom side which cooperates with a guide member on the window casement to guide the casement within the frame during pivoting about the second axis. To this end, the guide member is rotatably mounted in the casement and has a depending support member on one side of the rail on the window frame and a depending roller which engages on an opposite side of the rail for guiding the casement along the rail during pivoting of the casement about the axis at the mid-area of the casement.

The pivot pin which is secured to the casement at the upper end and the support member at the lower end of the casement are mounted on a third vertical axis which is spaced from the axes of the ends of the support arms. This third axis is located at a corner of the window frame.

In accordance with the invention, the bore in the support member of the carriage has a diameter greater than the diameter of the pivot pin which passes there-through and less than the outer diameter of the part spherical seat.

Achieved according to the invention is that within permitted, limited pivotal movements of the first pivotal axis of the window casement, the carriage-forming guide means can be ensured corresponding relative movements relative to the support pin and its support head immediately a need arises for this. One can ensure that the relative pivotal movements between the carriage-forming guide means and the support pin and its head take place in a region which lies tightly up to the center of the carriage-forming means, but nevertheless not more tightly up to this center than that a controlled movement of the carriage can still be guaranteed relative to the support pin and relative to the horizontal guide, controlled by the weight loading from the window casement.

It is preferred that the pivot bearing-forming seat, which is formed in a cavity internally in the carriage-forming guide means, together with the adjacent vertical bore are arranged tightly up to the wheels of the guide means.

By arranging both the seat and the bore relatively tightly up to the wheels of the guide means, an easy pivoting about of the guide means with associated wheels can be ensured relative to the support pin and associated support head, so that the guide means can be held in place in the intended support position in the associated guide during any displacement of the window casement. In practice, however, sufficient material around the seat and the bore is ensured, but nevertheless not more material than that which is necessary for reasons of strength. At the same time, a carriage having minimal dimensions can be ensured which is easy to fit into the horizontal guide in the window frame.

In order that the invention can be more clearly understood, a convenient embodiment thereof will now be described by way of example, with reference to the accompanying drawings in which:

BRIEF DESCRIPTION OF THE INVENTION

FIG. 1 is a vertical elevation of a window according to the invention,

FIG. 2 is a vertical section of an upper and a lower portion of the window of FIG. 1, FIG. 3 is a schematic representation, in part, of a window casement seen from above and illustrated in a closed position, FIG. 4 is a schematic horizontal section of the window with the window casement illustrated in various ventilation positions, shown in broken and chain lines, FIG. 5 is a schematic perspective elevation of part of a lower guide and an associated lower guide member, illustrated out of engagement with each other, FIG. 6 is a plan view of a carriage-forming guide component, FIG. 7 is a cross-section of the carriage-forming guide component in combination with its associated horizontal guide, FIG. 8 is a side representation of a saddle member which is to be fastened to the carriage-forming guide component, and FIG. 9 is a side representation of a main portion which forms a part of the carriage-forming component.

DETAILED DESCRIPTION OF THE INVENTION

Figure 1:
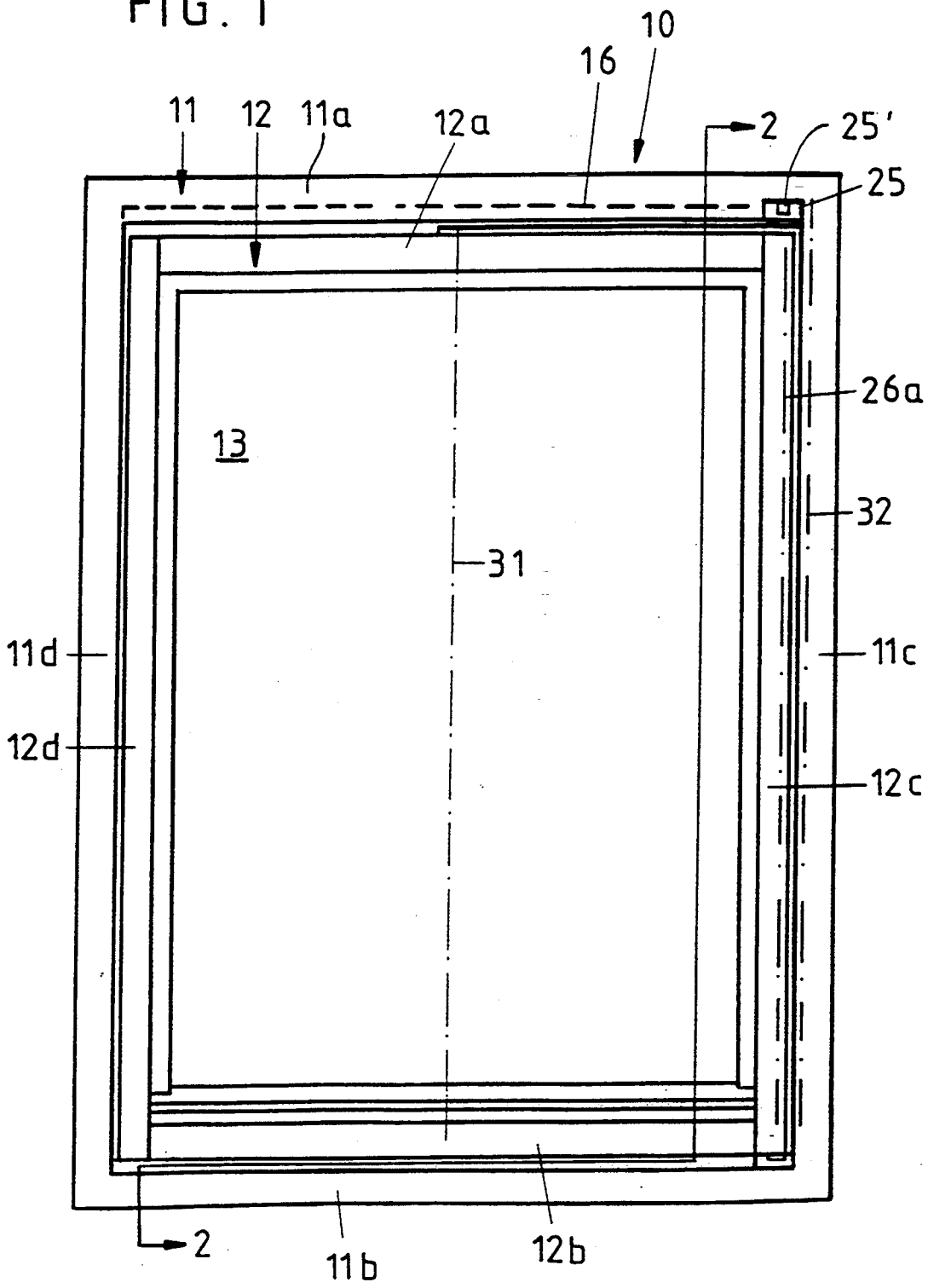

Referring to FIG. 1 a side-hinged, 180 degrees rotatable window 10 comprises a window frame 11 of wood and a window casement 12 of wood. Window glass 13 is fastened in the window casement 12 in a conventional manner as is shown in FIG. 2.

Figure 2:
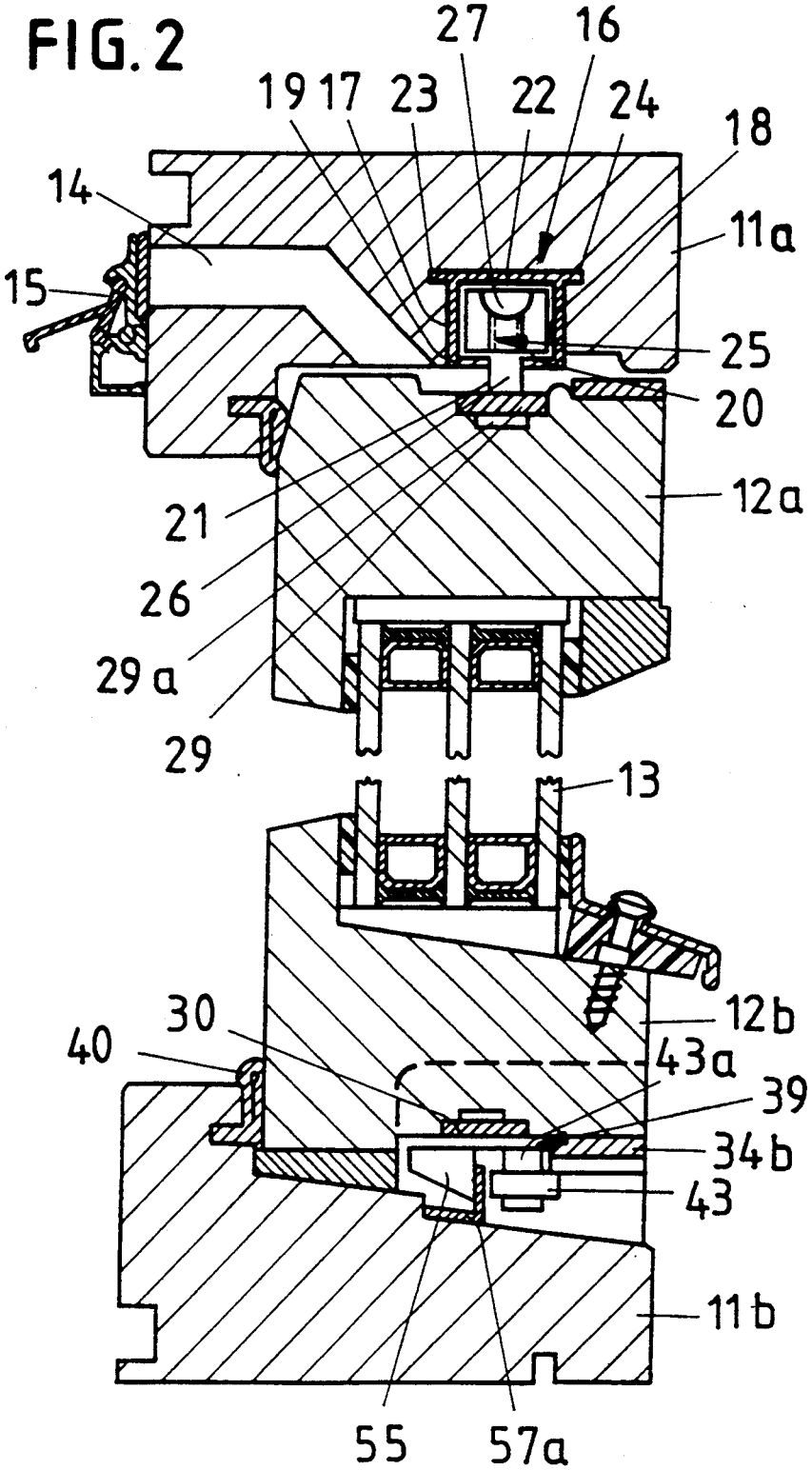
Figure 5:
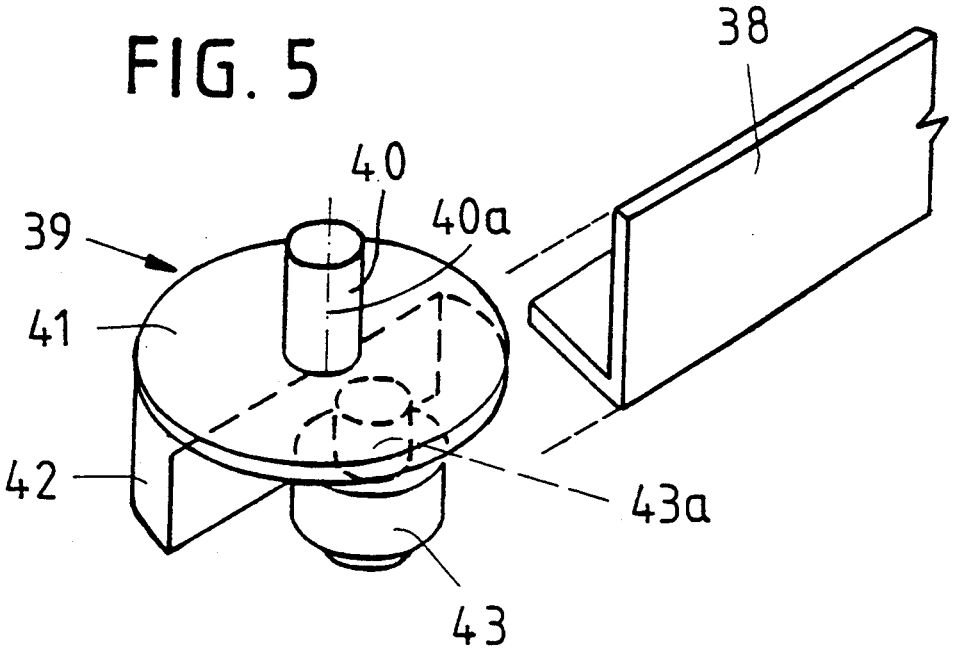

As shown in FIG. 2, there is illustrated on the inner side of the window frame 11, by an upper horizontal frame member 11*a*, an air duct 14, one end of which is controlled by an associated air valve 15 arranged on the inner side of the window and the opposite side of which discharges centrally outwards in the frame member 11*a* in an associated window rabbet.

Just outside the air duct 14, a groove is cut out in the frame member 11*a* and receives a horizontal guide-forming C-shaped profile rail 16 of metal, in a self-locking manner known per se. The C-shaped form of the guide or the rail 16 comprises two side portions 17, 18, which outermost (lowermost in FIG. 2) extend over into two support flanges 19, 20 directed towards each other having an intermediate, downwardly opening guide slot 21 and which above are connected to each other by means of a web portion 22. The web portion 22 is extended outwardly on opposite sides of the rail with fastening ribs 23, 24, which are anchored in equivalent sideways-directed portions of the groove. The rail 16 can thereby be securely held in the groove and transfers the weight loading from the rail 16 to the frame member 11*a*, the weight loading from the window casement 12 to the window frame 11 occurring via the support flanges 19, 20, as will be described as follows.

Along the horizontal, guide-forming rail 16 there is displaceably received a first carriage-forming guide component in the form of a support member 25 for the window casement. In a middle, vertical bore 25*a* in the support member 25 there is pivotably mounted a pivot pin 26, which is rigidly connected to one, upper corner of the window casement 12, and which is adapted to receive the weight of the window casement 12 and to transfer this to the window frame 11 via a support head 27 on the pivot pin 26 to a pivot bearing-forming seat 25' internally in the support member 25, that is to say a seat 25' which is arranged below the upper surface of the support member 25 and generally within the generatrix of the support member 25.

According to the invention, provision is made for the seat 25' to have a part-spherical support surface for an equivalent part-spherical support surface 27' on the support head 27. In other words, provision is also made for the support head 27—at the same time as it can be rotated about the pivotal axis 26*a* of the pivot pin 26—to be pivotable about axes which extend across the pivotal axis 26*a*.

The stem portion 28 of the pivot pin 26 is shown (see FIG. 7) with a somewhat smaller diameter D2 than diameter D1 of the bore 25*a*, so that the pivot pin 26 can be pivoted about a horizontal axis which crosses the pivotal axis 26*a*, relative to the bore 25*a*.

The stem portion 28 of the pivot pin 26 is provided at its lower end portion 28*a* with a substantially hexagonal cross-section and by means of a locking head 29*a* is rigidly connected at this end portion to a fastening mounting 29 (see FIG. 2), which is secured by screws (see FIG. 3) to the upper horizontal casement member 12*a* of the window casement 12.

The fastening mounting 29 spans over approximately half the length of the window casement member 12*a* and is provided approximately at the middle of the window casement member 12*a*, at one outer side of the window casement and just within the generatrix of the window casement, with a fastening 33*a* (see FIG. 3) for pivotable fastening of the one end of a vertical pivot pin 35*a* associated with an upper pivot or support arm 34*a*. The opposite end of arm 34*a* is mounted via a second vertical pivot pin 36*a* in a fastening mounting 37*a* which is fastened by screws to the frame member 11*c* just at one, upper corner associated with the frame 11.

A second fastening mounting 30, corresponding to the fastening mounting 29, is fastened at the lower horizontal casement member 12*b* of the window casement 12. The fastening mounting 30 is provided with a fastening for pivotable fastening of the one end of a vertical pivot pin associated with a lower pivot and support arm 34*b*. The opposite end of the arm 34*b* is mounted via a second vertical pivot pin in a fastening mounting, which is fastened by screws to the frame member 11*c* just by the lower corner associated with the frame 11.

The window casement 12 is consequently pivotably mounted at its one vertical casement side about a first vertical pivotal axis which is formed by pivotal axis 26*a* of the pivot pin 26. Furthermore, at its middle portion (see FIG. 1), the window casement 12 is pivotably mounted about a second vertical pivotal axis 31, which coincides with the pivotal axis for one pivot pin 35*a* of the arms 34*a*, 34*b*. The opposite end of the arms 34*a*, 34*b* is pivotable about a third vertical pivotal axis 32, which coincides with the pivotal axis for the second pivot pin 36*a* of the pivot arms 34*a*, 34*b*.

On opening the window from the starting position illustrated in FIGS. 1 and 2, one vertical casement member 12c of the window casement 12 is guided along the window frame by controlling the carriage-forming guide component 25 in the associated guideforming rail 16 in the window frame 11. In other words, the window casement 12 is pivoted about the first pivotal axis 26*a* relative to the carriage-forming guide component 25 and about the second pivotal axis 31 relative to the arms 34*a*, 34*b* by a corresponding outward pivoting of the arms 34*a* and 34*b* about the third pivotal axis 32. By this, the window casement 12 is swung in a controlled manner with the second vertical casement member 12*d* of the window casement free endingly outwards from the window frame, as is shown by broken and chain lines in FIG. 4.

The window casement 12 is supported at the lower end of the inner vertical casement member 12*c* in a guide-forming rail 38 having an L-shaped profile. A guide member 39 is fastened to the window casement directed vertically downwards from the lower casement member 12*b* at the lower end of the casement member 12*c*. The guide member 39 comprises a pivot pin 40 which is rotatably mounted in the fastening mounting 30 and a disc-shaped head portion 41 projecting downwards from the pivot pin 40. On the one half, the head portion 41 supports a semi-cylindrical support member 42 and on the other half, a support roller 43 which is rotatably mounted about a vertical shaft pin 43*a* which extends parallel to the pivotal axis 40*a* of the pivot pin 40. Between the support roller 43 and the support member 42, there is formed a guide for the reception of the vertical L-leg of the rail 38 (as shown in FIG. 2). The support roller 43 will provide a correcting control and horizontal supporting of the lower corner of the window casement 12 at the lower end of the casement member 12*c* during pivoting of the window casement 12 to and from the illustrated starting position. The support roller 43 will be particularly effective in the support of the window casement in its maximum outwardly swung ventilation position, as is illustrated by the chain lines in FIG. 4, since the window casement 12 will then discharge a support force from the support roller 43 at right angles towards the vertical L-leg of the rail 38. In the outer position (the closed position of the window) as shown in FIGS. 1 and 2, (and respectively in the opposite outer position on swinging the window casement approximately 180 degrees) the lower, inner corner of the window casement 12 can be supported against the lower rabbet portion of the window frame 11 via a stationarily fastened support block 45.

Figure 6:
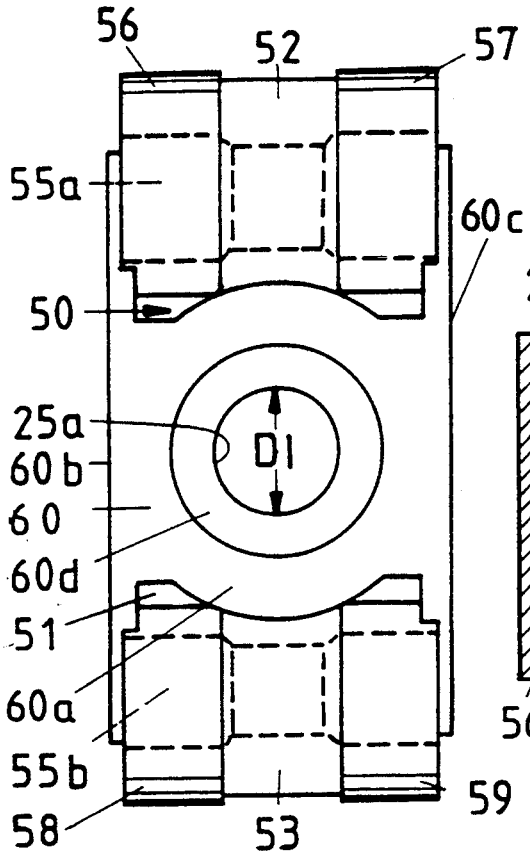
Figure 8:
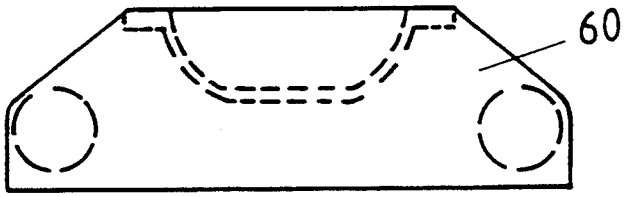

In the illustrated embodiment the carriage-forming guide component 25, is fashioned as shown in FIGS. 6 and 8 with an elongate cross-shaped main portion 50 having a thickened, cross-piece forming middle portion 51 and two longitudinal piece-forming end portions 52 and 53 directed oppositely from this.

In the thickened middle portion 51, there is shown a vertical bore 25*a* having an internal diameter D1 which is approximately 20% greater than the external diameter D2 of the pivot pin 26. Above, the bore 25*a* is enlarged with a part-spherical seat 25' having a maximum diameter D3 approximately equal to 2D2, the head portion 27 of the pivot pin 26 being fashioned with an equivalent part-spherical support surface 27' having a substantially corresponding diameter D3.

Across the end portions 52 and 53 there extend horizontal bores 52*a* and 53*a* for the reception of pivot shafts 55*a* and 55*b* respectively for their respective sets of oppositely arranged support wheels 56, 57, and 58, 59.

Figure 7:
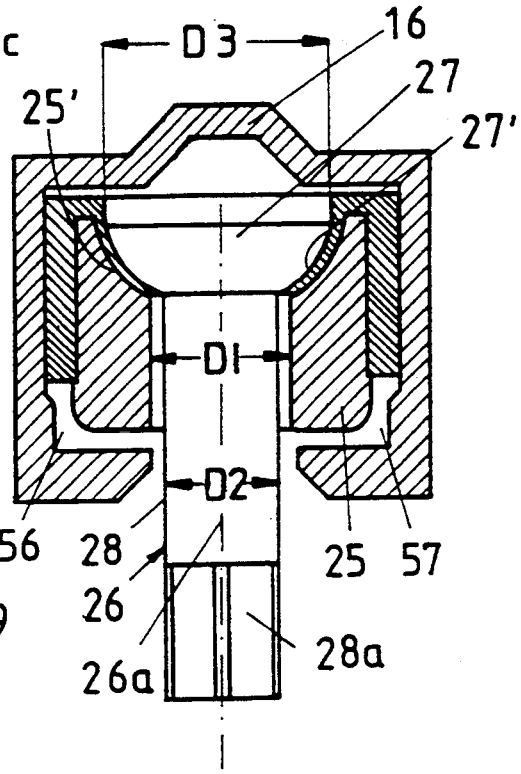
Figure 9:
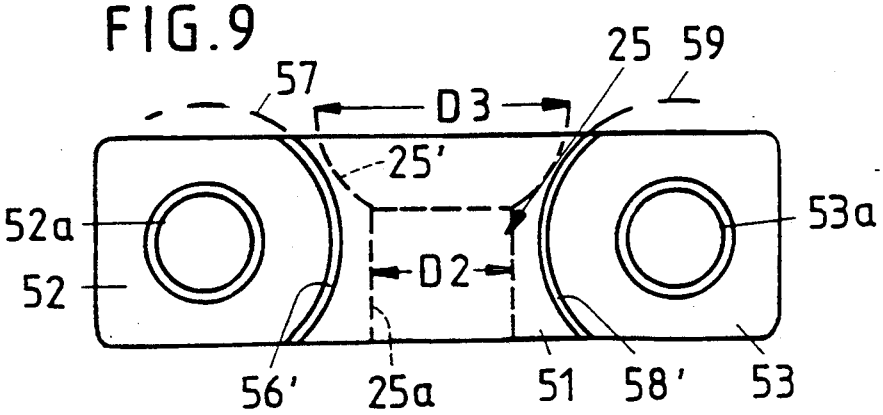

In FIGS. 6, 7 and 9 there is illustrated a placing of the support wheels 56–59 having a relatively small axial space and positioned relatively tightly up to the bore 25*a* and the spherical seat 25', the cavities 56' and 58' for the associated support wheels being equivalently rounded off in the thickened middle portion 51.

In FIGS. 6, 7 and 8 there is illustrated a saddle-shaped hood member 60, which is made of friction-reducing plastic material. The hood member 60 is threaded into place on top of the cross-shaped main portion 50 with supporting abutment via an annular portion 60*a* against the top surface of the main portion 50 and via angled side members 60*b*, 60*c* against adjacent side surfaces of the main portion 50. The hood member 60 is fashioned with a part-spherical middle portion 60*d* radially within the annular portion 60*a* to form a rotary and pivot bearing for the head portion 27 of the pivot pin 26 in combination with seat 25' of the carriage-forming guide component 25. Side members 60*b*, 60*c* of the hood member 60 are extended outside pivot pins 55*a*, 55*b* of the wheels 56–59 to form end supports for these.

On mounting the carriage-forming guide component 25 from the position which is illustrated in FIG. 9, the wheels 56–59 are first set into place on the pivot pins 55*a*, 55*b* on the main portion 50 and are thereafter secured in position by means of the hood member 60, while the hood member 60 is correspondingly secured in position on the main portion 50 on reception of the head portion 27 of the pivot pin 26 in the seat 25'.

I claim:

1. A window construction comprising a window frame;

a window casement side-hingedly mounted in said frame for rotation through 180 degrees;

a carriage containing support wheels displaceable in a first horizontal guide of said window frame;

said casement being pivotally mounted about a first vertical axis at one upper end thereof via a first pivot pin of said carriage and at a lower corner thereof via a second pivot pin of a lower guide member displaceable in a second horizontal guide of said window frame;

said casement being pivotally mounted approximately at its center axis about a second vertical axis at one end of upper and lower support arms while the opposite end of each said arm is pivotally mounted about a third vertical axis at an associated corner of said window frame;

said carriage being adapted to support said window casement in a suspended condition via a support head at the upper end of a stem portion of said first pivot pin and designed with a partially spherical seat forming a pivot bearing for an equivalent partially spherical support surface of said support head; and said carriage defining a vertical bore through which said first pivot pin passes between forward and rear wheels thereof, the diameter of said vertical bore being less than the diameter of said seat and greater than the diameter of said stem portion of said first pivot pin.

2. The window construction according to claim 1, wherein the seat is formed in a cavity internally in the carriage and lies adjacent the vertical bore, said seat and said bore being disposed relatively tightly up to the forward and rear wheels of the guide means.

3. The window construction according to claims 1 or 2, wherein a readily mountable saddle-shaped hood member is threaded on the carriage-forming guide means to form a rotary and pivot bearing for the support head of the pivot pin in connection with the seat of the carriage, said saddle member being made of friction-reducing material which covers at least portions of the wheels of the guide means.

4. The window construction of claim 3, wherein the saddle member forms an end cover for the wheels.

5. A window construction comprising a window frame having a first horizontally disposed guide in an upper side thereof;

a window casement mounted in said frame;

a pair of horizontally disposed support arms, each arm being pivotally secured at one end to said window frame on a first vertical axis and pivotally secured at an opposite end to said window casement on a second vertical axis disposed in a mid-area of said window casement, said arms being disposed on opposite sides of said casement to permit pivoting of said casement about said second vertical axis;

a carriage disposed in said guide, said carriage including a support member having a vertically disposed bore therein and a part-spherical seat concentric to said bore and a plurality of wheels supporting said support member for movement along said guide; and a pivot pin secured to said casement and passing through said bore of said support member of said carriage, said pin having a part spherically shaped head pivotally mounted on said seat of said support member for supporting said casement from said guide during movement of said carriage along said guide.

6. A window construction as set forth in claim 5 wherein said window frame has a horizontally disposed rail on a lower side thereof and which further comprises a guide member rotatably mounted in said casement and having a depending support member on one side of said rail and a depending roller engaging on an opposite side of said rail for guiding said casement along said rail during pivoting of said casement about said second axis.

7. A window construction as set forth in claim 5 wherein said bore in said support member has a diameter greater than the diameter of said pivot pin and less than the outer diameter of said seat.

8. A window construction as set forth in claim 5 wherein said pivot pin is disposed on a third vertical axis spaced from said first axis and said second axis.

9. A window construction as set forth in claim 5 wherein said carriage has a saddle-shaped hood member mounted on said support member of plastic material, said hood member having a part-spherical portion disposed on said seat of said support member to pivotally receive said head of said pivot pin therein.

10. A window construction as set forth in claim 9 wherein said support member has a pair of pivot pins at opposite ends, each said pin of said pair of pins rotatably supporting a pair of wheels thereon and wherein said hood member has a pair of depending side members for supporting said pair of pivot pins in said support member.

11. A window construction as set forth in claim 5 wherein said guide is of C-shaped cross-section having a pair of spaced apart support flanges supporting said carriage thereon with said pivot pin depending between said flanges.

* * * * *